US007322851B2

(12) United States Patent
Brookmire

(10) Patent No.: US 7,322,851 B2
(45) Date of Patent: Jan. 29, 2008

(54) COAXIAL CABLE CONNECTOR

(76) Inventor: Jeffrey Brookmire, 1221 Promontory Path, Marietta, GA (US) 30062-2985

( * ) Notice: Subject to any disclaimer, the term of this patent is extended or adjusted under 35 U.S.C. 154(b) by 0 days.

(21) Appl. No.: 11/341,204

(22) Filed: Jan. 27, 2006

(65) Prior Publication Data

US 2007/0178759 A1 Aug. 2, 2007

(51) Int. Cl.
*H01R 9/05* (2006.01)

(52) U.S. Cl. ..... 439/578; 439/822

(58) Field of Classification Search ..... 439/578, 439/822, 835, 828, 826
See application file for complete search history.

(56) References Cited

U.S. PATENT DOCUMENTS

| | | | | |
|---|---|---|---|---|
| 1,999,613 | A * | 4/1935 | Mueller et al. | 439/822 |
| 2,986,720 | A | 5/1961 | Chess et al. | |
| 3,008,114 | A * | 11/1961 | Adkins | 439/224 |
| 3,206,540 | A | 9/1965 | Cohen | |
| 3,821,689 | A * | 6/1974 | Graham | 439/482 |
| 3,910,665 | A | 10/1975 | Stull | 339/17 |
| 3,966,292 | A | 6/1976 | Schultz | 339/91 |
| 4,153,321 | A * | 5/1979 | Pombrol | 439/437 |
| 5,123,861 | A * | 6/1992 | Verge | 439/522 |
| 5,147,221 | A | 9/1992 | Cull et al. | 439/585 |
| 5,183,412 | A | 2/1993 | Nagafuji | 439/578 |
| 5,613,884 | A * | 3/1997 | Krivec | 439/822 |
| 6,132,234 | A | 10/2000 | Waidner et al. | 439/358 |
| 6,299,479 | B1 | 10/2001 | Tang | 439/578 |
| 6,705,884 | B1 | 3/2004 | McCarthy | 439/394 |
| 2004/0014350 | A1 | 1/2004 | McMullen et al. | |
| 2005/0164552 | A1 | 7/2005 | Wlos et al. | |

* cited by examiner

*Primary Examiner*—James R. Harvey
*Assistant Examiner*—X. Chung-Trans
(74) *Attorney, Agent, or Firm*—James W. Kayden; Thomas, Kayden, Horstemeyer & Risley, LLP

(57) ABSTRACT

A coaxial cable connector including a plurality of arms, each arm having: a lever, a gripper having inwardly extending teeth, the gripper being on an opposite side of a longitudinal axis of the coaxial cable connector from the lever, and a joint connecting the lever to the gripper, the joint traversing the longitudinal axis to connect the lever to the gripper.

17 Claims, 1 Drawing Sheet

COAXIAL CABLE CONNECTOR

TECHNICAL FIELD

The present disclosure relates generally to the field of electrical connectors, and more particularly to the field of coaxial cable connectors.

BACKGROUND

A coaxial cable is a type of cable that is capable of transmitting a signal propagating along an electromagnetic wave. The coaxial cable may have a core conducting wire that is separated from a cylindrical conducting shield by a spacer. The core conducting wire may be a solid or stranded wire formed from a metal such as copper. The conducting shield may be a foil layer of or a braid of conducting metal such as copper or aluminum. The conducting shield may be grounded to minimize interference. The spacer may be a dielectric that surrounds the core conducting wire and is surrounded by the conducting shield. The electromagnetic wave exists within the spacer, and therefore characteristics of the spacer significantly affect the characteristics of the cable, such as impedance. Because the electromagnetic wave may exist within the spacer, interference from outside sources may be minimized. The coaxial cable may have a protective sheath covering the conducting shield to further minimize interference. The protective sheath may be a durable and insulating material.

A wide variety of industrial and consumer applications use coaxial cables, and differing applications may use cables having differing characteristics. To ensure the selected cable is suited for the application, cables may have designations indicating the characteristics of the cable. For example, a cable may have a designation with the prefix "RG", meaning "radio grade" or "radio guide", indicating the cable may be used to transmit signals including radio-frequency signals.

At an end, the cable may have a connector to facilitate connecting the cable to a device. Like the cable itself, connectors may be suitable for particular applications and may be sized and shaped for use with particular cables. For example, an "RF" (radio-frequency) connector is a connector that may be used with RG-type cables. Often, each connector may have a male version and a female version. For example, the male connector may be coupled to the cable and the female connector may be coupled to a device. To attach the cable to the device, the male connector may engage the female connector. For example, the male connector may have a threaded interior that screws onto a threaded exterior of the female connector.

One type of connector having threads is an F connector, which is a type of "RF" connector. A conventional female F connector comprises a cylinder having a threaded exterior and a centrally-located hole for receiving the conducting wire of the cable. A conventional male F connector comprises a sleeve having a nut-shaped exterior and a hollow, cylindrically shaped interior that is threaded. The male F connector slips over and is secured to the RG-type cable, with the conducting wire extending through the hollow interior. To attach the male F connector to the female F connector, the male F connector is threadedly engaged to the female F connector.

Coaxial cable may be used with the transmission of television services. To receive this service, a coaxial cable carrying a television signal may be joined to a device such as a television, a VCR, a DVR, a cable box, or a satellite receiver. The coaxial cable may have a male F connector and the device may have a female F connector, and the male F connector on the cable may be screwed onto the female F connector on the device.

Although the design of a conventional male F connector provides a secure connection, it may be difficult to screw the male F connector onto the female F connector. Often, the female F connector is located on a back of the device, which may be cumbersome to reach without moving the device. A user may have to put himself in a physically awkward position to reach the female F connector, and may be required to attach the cable with one hand. Also, it may be easier for the threaded interior of the male F connector to initially engage the threaded exterior of the female F connector if the male F connector is held substantially parallel to the female connector. However, it may be cumbersome to simultaneously hold the male F connector parallel to the female F connector and to twist the nut-shaped exterior of the male F connector, especially if the user is working with one hand. Due to the number of threads, attaching the male F connector may be time consuming, and a user may believe the threads on the male F connector are engaging the threads on the female F connector when in fact the threads are not engaging. It is not uncommon for a user to believe he has effectively screwed the male F connector onto the female F connector, but for the male F connector to completely disengage from the device once the user removes his hand. Additionally, movement of the device may cause the cable to disengage from the device if the male F connector is not securely connected.

Recently, cable service providers have expanded their service offerings to include internet access services and voice-over-IP telephone services. To receive these services, a cable modem is attached to the coaxial cable, usually by attaching a male F connector on the coaxial cable to a female F connector on the cable modem. The cable modem may be attached to a computer, and the signal passing through the connector establishes internet connectivity. The cable modem may also be attached to a router or a phone adapter that is connected to a telephone to establish telephone services. However, a user may encounter the same difficulties joining the coaxial cable to the cable modem as he encounters when joining the coaxial cable to a television.

From the above, it is apparent that a need exists for a male coaxial cable connector that can be easily attached to and released from a conventional female coaxial cable connector, the female connector having a threaded exterior.

SUMMARY

Coaxial cable connectors are disclosed. In one embodiment, a coaxial cable connector may have a plurality of arms, and each arm may include a lever, a gripper having inwardly extending teeth, and a joint connecting the lever to the gripper. The gripper may be on an opposite side of a longitudinal axis of the coaxial cable connector from the lever, and the joint may traverse the longitudinal axis to connect the lever to the gripper.

In another embodiment, a coaxial cable assembly may include a coaxial cable, and a coaxial cable connector coupled to the coaxial cable. The coaxial cable connector may have a plurality of arms, and each arm may include a lever, a gripper having inwardly extending teeth, and a joint connecting the lever to the gripper, the gripper being on an opposite side of a longitudinal axis of the cable than the lever.

In another embodiment, a method of attaching a male coaxial cable connector to a female coaxial cable connector may comprise compressing at least one lever of the male connector to move at least one gripper of the male connector in a direction away from a coaxial cable, the coaxial cable being positioned along a longitudinal axis, inserting an inner conducting wire of the coaxial cable into an opening on the female connector, and releasing the at least one lever to move the grippers toward a threaded outer surface of the female coaxial cable connector to engage teeth on the grippers with the threaded outer surface of the female coaxial cable connector.

Other systems, devices, features and advantages of the disclosed coaxial cable connector will be or become apparent to one with skill in the art upon examination of the following drawings and detailed description. It is intended that all such additional systems, devices, features, and advantages be included within this description, be within the scope of the present invention, and be protected by the accompanying claims.

BRIEF DESCRIPTION OF THE DRAWINGS

The present disclosure may be better understood with reference to the following drawings. Matching reference numerals designate corresponding parts throughout the Figures, and components in the drawings are not necessarily to scale.

DETAILED DESCRIPTION

As described above, a need exists for a male coaxial cable connector that quickly joins to and releases from a female coaxial cable connector having a threaded exterior surface. As is described below, one such male connector may be formed having arms, each arm having a gripper that may engage threads on the female connector. The male connector may be quickly attached to and released from the female connector by compressing and releasing levers on the arms.

Figure 1:
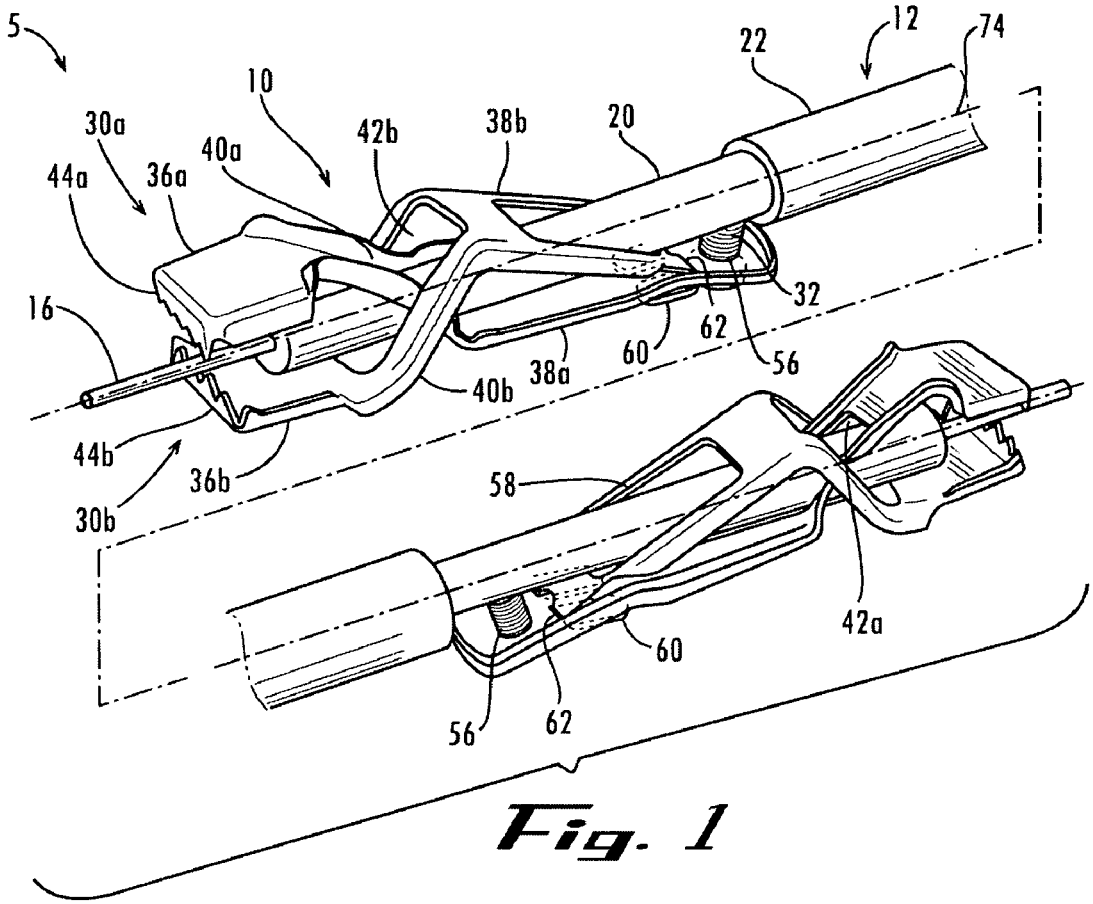
FIG. 1 is a perspective view depicting an embodiment of a male coaxial cable connector coupled to a coaxial cable.

Referring now to the Figures, FIG. 1 shows a perspective view of an embodiment a male coaxial cable assembly 5 having a male coaxial cable connector 10 coupled with a conventional coaxial cable 12. The cable 12 may be a cylindrical cable having substantially concentric cylindrical layers including an inner conducting wire 16, a dielectric spacer, an outer conducting shield 20, and an exterior protective sheath 22. As illustrated in FIG. 1, the protective sheath 22 may be omitted or stripped away along a distal portion of the cable 12, exposing the outer shield 20. In other embodiments, the distal portion may have the protective sheath 22. At a distal tip of the cable 12, the inner conducting wire 16 may protrude from the cable 12.

Along the distal portion of the cable 12, the male connector 10 may be physically coupled to the cable 12. Once the male connector 10 is coupled to the cable 12, a longitudinal axis 74 of the cable 12 may substantially align with a longitudinal axis of the male connector 10.

The male connector 10 has a plurality of arms 30. Each arm 30 may have a gripper 36, a lever 38, and a joint 40 connecting the gripper 36 to the lever 38. The arm 30 may be formed from a conducting material. In some embodiments, the arm 30 may be formed as a single piece from conducting metal. In other embodiments, the arm 30 may be formed from more than one piece of conducting material.

The gripper 36 may have a surface that may be substantially planar, and may have a distal edge that may be substantially straight, as shown in FIG. 1. Teeth 44 may extend inwardly from the distal edge. To facilitate a connection with the female connector, the teeth 44 may be sized and shaped to fit between threads on the female connector. In other embodiments, the surface and the distal edge of the gripper 36 may be curved inwardly to mate with an exterior curve on the female connector (not shown). The teeth 44 may also extend inwardly from a different location on the gripper 36. For example, the teeth may extend inwardly from the distal edge and the side edge of the gripper (not shown).

The lever 38 may be substantially planar, as shown in FIG. 1, or the lever may have other configurations. The joint 40 may be shaped such that, once the arm is coupled to the cable 12, the gripper 36 and the lever 38 may be on opposite sides of the longitudinal axis 74, and the joint 40 may traverse the longitudinal axis 74 to connect the gripper 36 to the lever 38. In some embodiments, the joint 40 may have an opening 42 to facilitate this configuration, and the cable 12 may pass through the opening 42 such that the lever 38 may be on the opposite side of the longitudinal axis 74 than the gripper 36.

As shown in the embodiment illustrated in FIG. 1, the male connector 10 may have two arms 30, including a first arm 30*a* and a second arm 30*b*. The first arm 30*a* may have a gripper 36*a*, a lever 38*a*, and a joint 40*a*, and the joint 40*a* may have an opening 42*a*. Likewise the second arm 30*b* may have a gripper 36*b*, a lever 38*b*, and a joint 40*b*. The joint 40*b* may have an opening 42*b*.

Once attached to the distal portion of the cable 12, the first arm 30*a* may mirror the second arm 30*b* along the longitudinal axis 74, the first arm 30*a* being opposite from and substantially aligned with the second arm 30*b* along the longitudinal axis 74. In such an embodiment, the grippers 36*a* and 36*b* may be substantially aligned on opposite sides of the longitudinal axis 74, with the teeth 44 of both grippers 36*a* and 36*b* extending inwardly toward the longitudinal axis 74. Likewise, the lever 38*a* of the first arm may be on an opposite side of the longitudinal axis 74 than the lever 38*b* of the second arm 30*b*. Because the joint 40*a* of the first arm 30*a* may extend across the longitudinal axis 74 to connect to the gripper 36*a*, and the joint 40*b* of the second arm 30*b* may extend across the longitudinal axis 74 to connect to the gripper 36*b*, the joints 40*a* and 40*b* may intersect. To facilitate the intersection, the joint 40*a* of the first arm 30*a* may pass through the opening 42*b* in the joint 40*b* of the second arm 30*b*.

The male connector 10 may also include a fastener 32. The fastener 32 may be used to fasten at least one lever 38 to the distal portion of the cable 12. For example, the fastener 32 may be a screw 56. The lever 38 may have a screw hole at a proximal end of the lever, and the screw 56 may be inserted through the screw hole to fasten the lever 38 to the distal portion. A bottom surface of the screw 56 may press against the distal portion without entering the cable 12, the screw 56 acting to clamp the arm to the distal portion. In other embodiments, the lever 38 may be fastened to the distal portion using other fasteners 32 that are known in the art. For example, the fastener 32 may be solder, and the lever 38 may be soldered to the distal portion (not shown).

Other arms 30 may be coupled to the at least one lever 38 that is fastened to the distal portion. For example, as described above and as shown in the embodiment illustrated in FIG. 1, the lever 38*a* may have a screw hole, and the lever 38*a* may be fastened to the distal portion with a screw 56.

The second arm 30*b* may then be attached to the first arm 30*a*. The second arm 30*b* may have a hole 58 and tabs 60 at a proximal end of the lever 38*b*, and the first arm 30*a* may have slots 62 configured to receive the tabs 60. The cable 12 may extend through the hole 58 on the second arm 30*b*, and the second arm 30*b* may attach to the first arm 30*a* by hooking the tabs 60 on the second arm 30*b* through the slots 62 on the first arm 30*a*.

Alternatively, each lever 38 may be individually fastened to the distal portion (not shown). In such an embodiment, the hole 58, tabs 60, and slots 62 may be omitted. For example, each lever 38 may have the screw hole, and the lever may be fastened to the distal portion with the screw 56. In other embodiments, the fastener 32 may be another fastener that is known in the art.

In addition to being physically coupled to the distal portion of the cable 12, the arm 30 may be electrically coupled to the outer shield 20 of the cable 12, to provide electrical grounding when the male connector 10 is connected to the female connector. The fastener 32 may be made from a conductive material, and fastening the arm 30 to the outer shield 20 may ground the arm. In the embodiment illustrated in FIG. 1, the protective sheath 22 may be removed so that the outer shield 20 is exposed along the distal portion. The screw 56 may be a conductive material, and the screw 56 may come into contact with the arm 30 and with the outer shield 20 to ground the arm. In other embodiments, the outer shield 20 may not be exposed along the distal portion, and the fastener 32 may extend through the protective sheath 22 to come into contact with the outer shield 20.

Once the arm 30 is coupled to the cable 12, the distal tip of the cable 12 may protrude past the teeth 44 of the gripper 36 along the longitudinal axis 74. The gripper 36 may be moved with respect to the longitudinal axis 74 by moving the lever 38, so that the gripper 36 may be moved closer to or farther from the distal tip. The lever 38 may have a resting position and a compressed position, the lever being farther away from the longitudinal axis when in the resting position than when in the compressed position. As mentioned above, the gripper 36 may be on the opposite side of the longitudinal axis 74 from the lever 38, due to the shape of the joint 40. Therefore, the gripper 36 may be in the closed position when the lever is in the resting position, and the gripper may be in the open position when the lever is in the compressed position, the gripper being closer to the longitudinal axis 74 when in the closed position than when in the open position.

Figure 2:
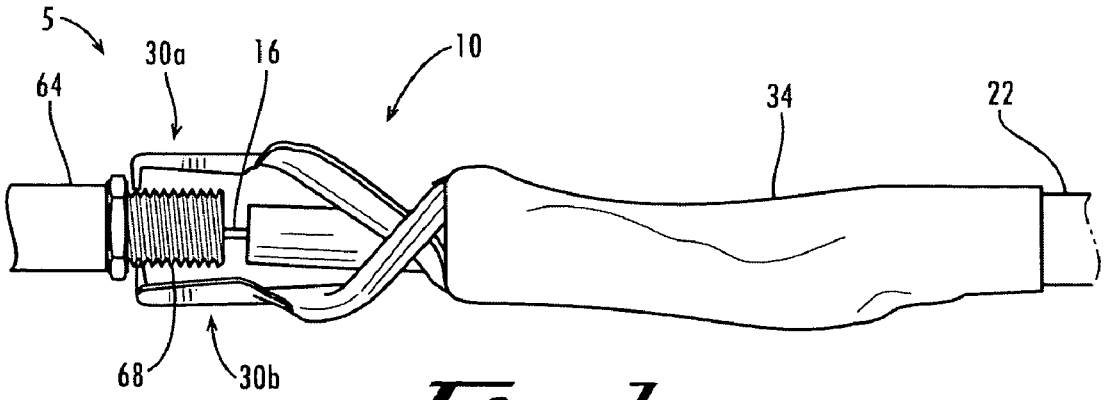
FIG. 2 is a side view of the male coaxial cable connector of FIG. 1 engaging a female coaxial cable connector.

The male connector 10 may also include an elastic retainer 34. The elastic retainer 34 may cover the lever 38 to maintain the lever in the resting position, so that the gripper 36 is maintained in the closed position. For example, an embodiment including an elastic retainer 34 is illustrated in FIG. 2, depicting the elastic retainer 34 covering the levers 38*a* and 38*b*, the fastener 32, and a portion of the length of the cable. The elastic retainer 34 may be a resilient material, and in some embodiments may be an insulating material.

In other embodiments, the male connector 34 may not include the elastic retainer 34. For example, the male connector 10 may include a spring positioned between at least two levers 38, the spring maintaining the levers in the resting position (not shown). In other embodiments, the lever may be configured to naturally assume the resting position without the aid of the elastic retainer 34 or the spring, and the lever may naturally return to the resting position once compression is released from the lever.

The male connector 10 may then be joined to a female coaxial cable connector 64, as shown in FIG. 2. The female connector 64 may be substantially cylindrical, having surfaces that are substantially cylindrical. An exterior surface of the female connector 64 may have threads 68, and an interior surface of the female connector may define a tube. The tube may be shaped and sized to mate with the inner conducting wire 16 of the cable 12. The tube may be substantially aligned with a central axis of the female connector 64.

The operation of the male coaxial cable connector 10 will now be described with reference to FIG. 2. The male connector 10 may be in a rest state with the levers in the resting position and the grippers in the closed position. The elastic retainer 34 may be compressed to move the levers from the resting position to the compressed position. Due to the shape of the joints, the grippers may be moved from the closed position to the open position. The elastic retainer 34 may be compressed until the grippers are opened wider than a width of the female connector 64. The male connector 10 may be moved toward the female connector 64, so that the longitudinal axis substantially aligns with the central axis of the female connector 64. The grippers may pass adjacent the exterior of the female connector 64, and the inner conducting wire 16 of the distal tip may enter the centrally-located tube of the female connector 64. The compression may be released from the elastic retainer 34, and the levers may return to the rest position so that the grippers return to the closed position. When in the closed position, the teeth 44 on the grippers may engage threads 68 on the exterior surface of the female connector 64, and the elastic retainer 34 may maintain the grippers in the closed position.

The arms may be electrically coupled to the outer shield, mitigating signal interference once the outer shield is connected to a grounded female connector. In some embodiments, the elastic retainer 34 may be made from an insulating material to further mitigate signal interference.

The embodiments described above are set forth as illustrative examples of the principles of the present disclosure to facilitate a clear understanding of the principles. Many variations and modifications may be made to the embodiments described above without substantially departing from the principles of the present disclosure. All such variations and modifications are intended to be included within the scope of the present disclosure, as protected by the following claims.

The invention claimed is:

1. A coaxial cable assembly comprising:

a coaxial cable having an inner conducting wire; and a coaxial cable connector coupled to the coaxial cable, the inner conducting wire of the coaxial cable extending through at least a portion of the coaxial cable connector, the coaxial cable connector having a plurality of arms, each arm including:

a lever;

a gripper having inwardly extending teeth; and a joint connecting the lever to the gripper, the gripper being on an opposite side of a longitudinal axis of the coaxial cable than the lever, wherein each joint comprises an opening, the cable extending through the opening of the joint of the first arm, and the joint of the first arm resting within the opening of the joint of the second arm.

2. The coaxial cable assembly of claim 1, wherein the plurality of arms comprises a first arm and a second arm, the first arm being positioned opposite from the second arm along the longitudinal axis, and the first arm being substantially aligned with the second arm along the longitudinal axis.

3. The coaxial cable assembly of claim 1, further comprising an elastic retainer substantially covering the levers of the arms, the elastic retainer being configured to maintain the grippers of the arms in a closed position.

4. The coaxial cable assembly of claim 1, further comprising a spring extending between the levers of at least two of the arms, the spring being configured to bias the levers to a resting position.

5. The coaxial cable assembly of claim 1, further comprising a fastener configured to secure at least one arm to the coaxial cable.

6. The coaxial cable assembly of claim 1, wherein the arm is electrically conductive.

7. The coaxial cable assembly of claim 6, wherein the arm is in electrical communication with a conducting shield of the coaxial cable.

8. A method of attaching a male coaxial cable connector to a female coaxial cable connector, the male connector having a lever a gripper having teeth and a joint connecting the lever to the gripper, the gripper being on an opposite side of a longitudinal axis of the coaxial cable than the lever, wherein each joint comprises an opening, the cable extending through the opening of the joint of the first arm, and the joint of the first arm resting within the opening of the joint of the second arm, and the male connector being coupled to a coaxial cable having an inner conducting wire, and the female connector having a threaded outer surface and an opening, the method comprising:

compressing the lever of the male connector to move the gripper of the male connector in a direction away from the coaxial cable;

inserting the inner conducting wire of the coaxial cable into the opening on the female connector; and releasing the lever to move the gripper toward the threaded outer surface of the female connector to engage teeth on the gripper with the threaded outer surface of the female connector.

9. A coaxial cable assembly comprising:

a male coaxial cable connector having a plurality of arms, each arm including:

a lever that can be moved between a resting position and a compressed position; and a gripper coupled to the lever, the gripper being in a closed position when the lever is in the resting position, and the gripper being in an opened position when the lever is in the compressed position; and a coaxial cable coupled to the male coaxial cable connector, the coaxial cable having an inner conducting wire that extends through at least a portion of the male coaxial cable connector, such that the male coaxial cable connector can be connected to a female coaxial cable connector by compressing the levers to move the grippers to the opened position, inserting the inner conducting wire into the female coaxial cable connector, and releasing the levers to move the grippers to the closed position, wherein each arm further comprises a joint connecting the lever of the arm to the gripper of the arm, the lever of the arm being on an opposite side of a longitudinal axis of the coaxial cable than the gripper of the arm, the inner conducting wire of the coaxial cable protruding past the grippers of the arms along the longitudinal axis, wherein at least one of the joints comprises an opening through which the inner conducting wire of the coaxial cable extends.

10. The coaxial cable assembly of claim 9, wherein the plurality of arms comprises a first arm and a second arm, the first arm being positioned opposite from the second arm along a longitudinal axis of the male coaxial cable connector, and the first arm being substantially aligned with the second arm along the longitudinal axis.

11. The coaxial cable assembly of claim 9, wherein each gripper is shaped to engage an exterior surface of the female coaxial cable connector when the gripper is in the closed position, such that the inner conducting wire is held within the female coaxial cable connector.

12. The coaxial cable assembly of claim 9, wherein each gripper includes inwardly extending teeth that can engage threads on an exterior surface of the female coaxial cable connector when the gripper is in the closed position, such that the inner conducting wire is held within the female coaxial cable connector.

13. The coaxial cable assembly of claim 9, further comprising an elastic retainer substantially covering the levers of the arms to maintain the levers of the arms in the resting position, so that the grippers are maintained in the closed position.

14. The coaxial cable assembly of claim 9, further comprising a spring extending between the levers of at least two of the arms to bias the levers to a resting position, so that the grippers are maintained in the closed position.

15. The coaxial cable assembly of claim 9, wherein each lever is configured to naturally assume the resting position when the lever is not being compressed.

16. The coaxial cable assembly of claim 9, wherein at least one arm is in electrical communication with a conducting shield of the coaxial cable.

17. The coaxial cable assembly of claim 9, wherein at least one arm is electrically conductive.

* * * * *